United States Patent [19]

Eshleman

[11] Patent Number: 4,635,899

[45] Date of Patent: Jan. 13, 1987

[54] AIR INLET VALVE SUBASSEMBLY WITH REPLACEABLE SEAL

[75] Inventor: Roger D. Eshleman, Waynesboro, Pa.

[73] Assignee: Eshland Enterprises, Inc., Greencastle, Pa.

[21] Appl. No.: 715,847

[22] Filed: Mar. 25, 1985

[51] Int. Cl.[4] ..... F16K 1/18

[52] U.S. Cl. ..... 251/298; 110/190

[58] Field of Search ..... 251/298, 307; 137/527.2, 527.4, 527.6; 110/188, 190

[56] References Cited

U.S. PATENT DOCUMENTS

| | | | |
|---|---|---|---|
| 908,961 | 1/1909 | Crabtree | 137/527.6 |
| 1,341,870 | 6/1920 | Woock | 137/527.8 |
| 1,430,818 | 10/1922 | Kilgore et al. | 137/527.8 |
| 2,000,474 | 5/1935 | O'Connor | 251/298 |
| 2,116,912 | 5/1938 | Richardson | 110/188 |
| 2,277,295 | 3/1942 | Brown | 137/527.4 |
| 2,336,486 | 12/1943 | Langdon | 137/527.4 |
| 3,036,814 | 5/1962 | Stevens | 137/527.4 |
| 3,060,961 | 10/1962 | Conley | 251/357 |
| 3,182,951 | 5/1965 | Spencer | 251/357 |
| 3,331,391 | 7/1967 | Merdinyan | 251/357 |
| 3,366,137 | 1/1968 | Hansen | 137/527.8 |
| 3,698,429 | 10/1972 | Lowe et al. | 251/307 |
| 3,783,893 | 1/1974 | Davison | 251/298 |
| 4,215,716 | 8/1980 | Klenk et al. | 137/527.6 |
| 4,455,969 | 6/1984 | Barker | 110/245 |

*Primary Examiner*—Martin P. Schwadron
*Assistant Examiner*—Sheri M. Novack
*Attorney, Agent, or Firm*—Michael R. Swartz; John R. Flanagan

[57] ABSTRACT

An air inlet valve subassembly for use on a particle fuel burning furnace includes a manifold tube and a hollow spout mounted to an outer end of the manifold tube. The spout has an outer rim defining a valve opening and the manifold tube is adapted to be mounted at its inner end to the furnace to provide a passageway for communicating air from the valve opening into the furnace. A valve flap is mounted adjacent to the spout for pivotal movement toward and away from the spout between closed and open positions in which the manifold tube passageway is closed and opened to the communication of air. For sealing the valve opening, a generally planar, resiliently flexible disk with an annular ring of gasket material adhered thereon is provided. The disk, preferably made of stainless steel material, is removably mounted to the valve flap at the respective centers thereof with its outer side facing toward the flap and its inner side facing toward the spout rim. The gasket material ring is affixed on the inner side of the disk and is capable of contacting the spout rim for providing an air seal between the disk and the spout rim when the valve flap is at its closed position. At least one wedge-shaped shim is insertable between the valve flap and the outer side of the planar disk to deflect the disk periphery and cause matching of the gasket material contour with the contour of the spout rim. An actuator is linked to the valve flap and is operable to cause movement of the flap between its closed and opened positions.

18 Claims, 7 Drawing Figures

AIR INLET VALVE SUBASSEMBLY WITH REPLACEABLE SEAL

CROSS REFERENCE TO RELATED APPLICATION

Reference is hereby made to the following copending application dealing with subject matter related to the present invention: "Particle Fuel Delivery Control Device" by Roger D. Eshleman, assigned U.S. Ser. No. 632,925 and filed July 20, 1984 and which issued Apr. 30, 1985 as U.S. Pat. No. 4,513,671.

BACKGROUND OF THE INVENTION

1. Field of the Invention

The present invention relates generally to particle fuel burning furnaces and, more particularly, is concerned with an air inlet valve subassembly which can be installed on new furnaces or retrofitted onto existing furnaces and has a replaceable seal which eliminates the possibility of extended downtime of the furnace for seal repair.

2. Description of the Prior Art

In times of constantly increasing energy costs, the utilization of waste materials as fuel to produce energy is of increasing importance. Waste materials are amply available from various sources, for example, agricultural, forestry and industrial operations.

Many different furnaces (including incinerators and the like) appear in the prior art for burning conventional types of fuel, such as coal and wood, as well as waste or by-product types of particle fuel, such as sawdust, pulverized trash and wood chips. Representative of the prior art are the furnaces disclosed in U.S. Pat. Nos. to Barnett (2,058,945), Evans (3,295,083), Midkiff (3,822,657), Kolze et al (3,865,053; 4,311,102; 4,377,115), Culpepper, Jr. (3,932,137), Leggett et al (3,951,082), Probsteder (4,218,980), Payne et al (4,378,208), Voss (4,385,567) and Ekenberg (4,430,949).

Another prior art furnace for burning waste product particle fuel is manufactured by Eshland Enterprises, Inc. of Greencastle, Pa. under the trademark "Wood Gun". Generally referred to as a wood gasification boiler, it has an insulated housing in which an upper, primary particle fuel retention and combustion chamber and a lower, secondary or afterburning combustion chamber are formed by refractory materials. A series of generally vertically extending passageways interconnect the bottom of the upper chamber with the top of the lower chamber. A quantity of waste particle fuel delivered into the upper chamber of the boiler through a fuel inlet in the top of the housing falls toward the bottom of the upper chamber and forms into a pile of fuel particles. The pile of particle fuel is ignited and burns from the bottom adjacent the location of the passageways. Periodically, the pile is replenished by delivery of additional particle fuel through the top fuel inlet of the housing.

Combustible gases generated as by-products from the burning of the particle fuel in the upper, primary chamber, along with air introduced into the upper portion of the primary chamber above the pile of fuel, are drawn downward through the passageways into the lower, secondary chamber by a draft inducing fan which creates a negative pressure drop in the lower chamber relative to the upper chamber. A suitable heat recovery unit is connected to the lower combustion chamber for capturing much of the heat produced by burning the combustible gases therein.

Air intake valves are mounted through the insulated housing of the furnace and are thermostatically controlled in a known manner to open when the temperature within the furnace falls below a preset level. The fan which induces the downward flow of air in the furnace causes inflow of air into the upper chamber through the valves when they are actuated to their open conditions. When the valves are closed, the upper chamber is substantially sealed. Optimum performance of this type of furnace can only be achieved if the air flow can be stopped completely to thereby prevent combustion from occurring when heat is not required. If a completely air tight seal is not obtained, a low level, smoldering fire will result which produces an overheat situation and undesirable creosote and moisture condensation in the boiler and fuel pile.

Prior attempts to provide a seal which would last through the entire heating season have failed. The presence of creosote and moisture condensation at the valve contact surface causes deterioration of the gasket or seal material. Thus, replacement of the seal at least once, and more likely several times, during the season has usually been necessary.

Heretofore, the gasket seal has been applied in the form of a bead of semi-fluid material about the rim of the air intake spout. Application of the seal occurred as the last step in the manufacture of the furnace in order to minimize the possibility of damage. Also, the rim of the air intake spout and the surface of the valve flap associated with the particular intake spout had to be matched to prevent leakage of air. This proved to be a costly and difficult adjustment to make during manufacture of the furnace. Then, later when gasket failure occurs during use of the furnace as it inevitably does, the problem must be corrected immediately to maintain system efficiency. However, the material best suited for the gasket is high temperature silicone which typically must be air dried for 24 hours before being subjected to operational service. This requirement represents a considerable inconvenience in cold weather when disruption of the heating system for even a few hours may cause severe consequences.

Many different sealable valve constructions used in a variety of different applications are known in the prior art. Representative of the prior art are the devices disclosed in U.S. Pat. Nos. to Crabtree (908,961), Woock (1,341,870), Kilgore et al (1,430,818), Brown (2,277,295), Langdon (2,336,486), Stevens (3,036,814), Conley (3,060,961), Spencer (3,182,951), Merdinyan (3,331,391) and Hansen (3,366,137). While these devices may operate satisfactorily under the particular conditions for which they are intended, it is not seen that any of these devices offer a satisfactory solution to the problem of providing an air tight seal under the rather rigorous environment present in a furnace of the above-described type. Consequently, a need exists for a gasket construction and mounting arrangement which will serve as an effective seal and then, upon failure thereof, can be easily and quickly replaced so as to eliminate the possibility of extended downtime of the furnace.

SUMMARY OF THE INVENTION

The present invention provides an air inlet valve subassembly with a replaceable seal designed to satisfy the aforementioned needs. The problem of seal replacement is solved by preforming an annular gasket directly on one side of a metal disk adjacent its peripheral edge. Then, the gasket is mounted such that a new one can be inserted quickly in place of the damaged one without any specialized tools. Furthermore, the thin, resiliently flexible nature of the replaceable gasket disk along with the manner in which it is mounted to the valve gate or flap improves the quality of the seal. Because the thin disk is attached to the valve flap by means of a single fastener located in the center thereof, it is possible to deflect the outer peripheral edge of the disk in the area of the gasket thereon by means of metal shims to make the disk periphery conform to the exact contour of the mating contact surface of the spout rim. In such manner proper seating of the annular ring of gasket material against the spout rim is ensured. Additionally, the air intake valve subassembly can be readily retrofitted to older furnaces as well as installed on new units.

Accordingly, the present invention sets forth in a particle fuel burning furnace having a particle fuel holding and combustion chamber and means forming at least one opening in the chamber for entry of air into the chamber for support of combustion of particle fuel therein, an air inlet valve subassembly connected with the chamber opening. The valve subassembly comprises: (a) air inlet means connected to the chamber opening and having a rim forming a valve opening, the air inlet means defining a passageway for communicating air from an external source, through the valve opening, and into the chamber; (b) a substantially rigid valve flap mounted adjacent the valve opening formed by the rim of the air inlet means for movement toward and away from the rim between closed and open positions in which the valve opening is closed and opened to the communication of air from the external source, through the passageway, and into the chamber; (c) a generally planar, resiliently flexible disk having opposite inner and outer sides and being removably mounted to the valve flap such that its outer side faces toward the flap and its opposite, inner side faces toward the valve opening formed by the rim; (d) an annular ring of gasket material affixed on the inner side of the disk and being capable of contacting the rim of the air inlet means for providing an air seal about the valve opening when the valve flap is at its closed position and thereby a substantially air tight seal of the air inlet means passageway; and (e) means insertable between the valve flap and the outer side of the planar disk at the periphery thereof so as to deflect the disk periphery away from the valve flap and thereby match the contour of the gasket material on the inner side of the disk with the contour of the rim.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
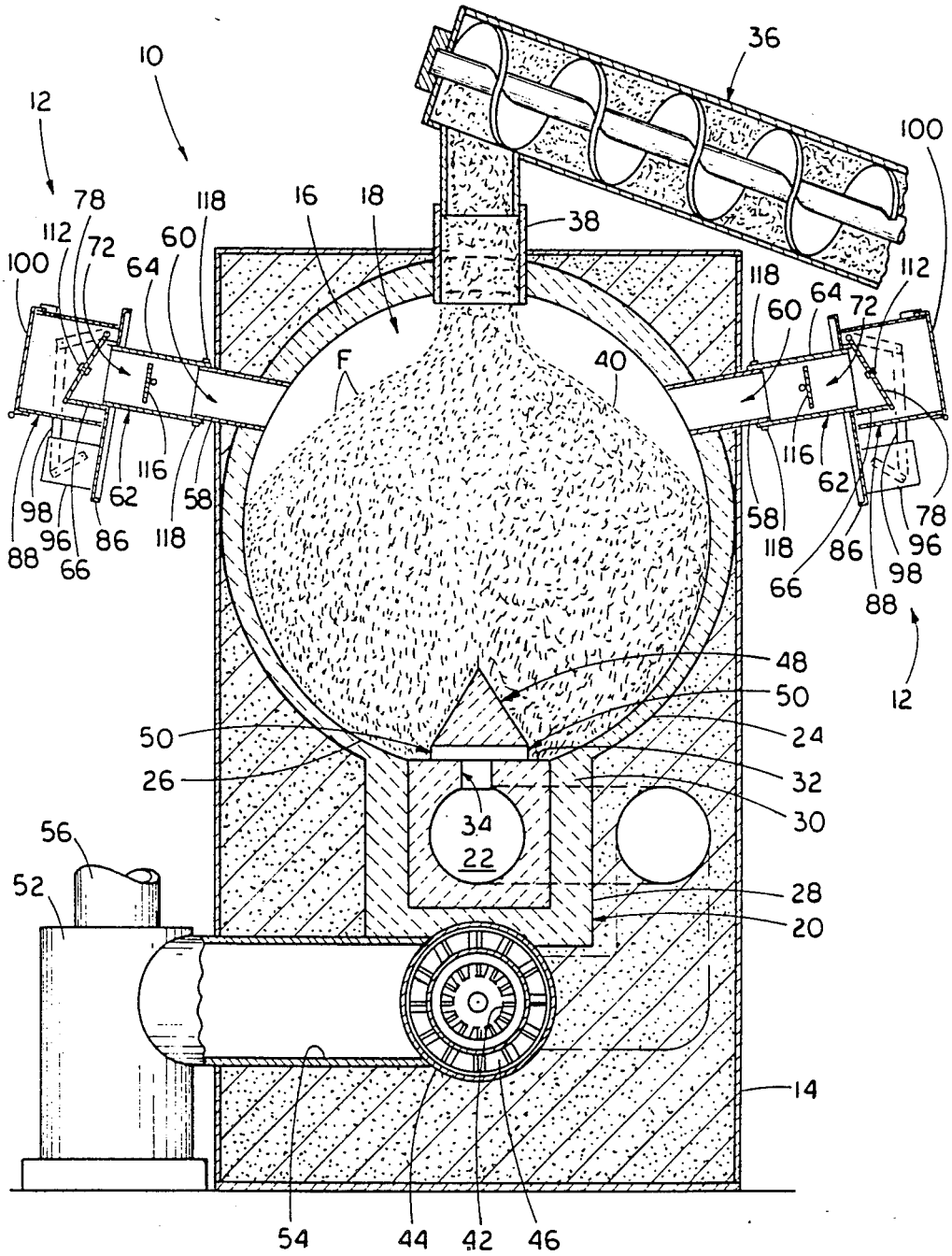
FIG. 1 is a sectional view of a particle fuel burning furnace employing the air intake valve subassembly of the present invention.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

In General

Referring now to the drawings, and particularly to FIG. 1, there is shown a furnace, being indicated generally by the numeral 10, for burning particle fuel F, for instance, composed of by-products of wood. At each opposite lateral side of the particle fuel burning furnace 10 is employed an air intake valve subassembly, generally designated 12, which comprises the preferred embodiment of the present invention and will be described in detail later.

The particle fuel burning furnace 10 includes a generally rectangular insulated jacket or housing 14 containing a cylindrical shaped lining 16 formed of refractory material which defines an upper, primary particle fuel retention and combustion chamber 18 and a rectangular shaped lining 20 also formed of refractory material which defines a lower, secondary or afterburning combustion chamber 22. Both of the upper and lower combustion chambers 18,22 are generally cylindrical in shape and extend generally parallel to one another. Since the upper chamber 18 also serves as to holding or retention chamber for the solid particle fuel F, such as sawdust, being burned in the furnace 10, the upper chamber 18 is much larger in diameter than the lower chamber 22, although they both have substantially the same axial length.

The lining 20 defining the lower chamber 22 has a double wall construction, as seen in FIG. 1, which makes it much thicker than the lining 16 forming the upper chamber 18. The cylindrical upper chamber lining 16 is open along its bottom where its laterally spaced edges merge at 24,26 with respective spaced apart upper edges of an outer box-like wall portion 28 of the rectangular lining 20. An inner block-like wall portion 30 of the lining 20, which defines the lower chamber 22, nests within the outer wall portion 28 and at its upper surface 32 forms the bottom of the upper chamber 18.

Within the inner block-like wall portion 30 of the lining 20 and between left and right ends of the chambers 18,22 is formed a series or row of spaced apart, generally vertically-extending passageways 34 (only one of which is seen in FIG. 1) which interconnect the bottom of the upper chamber 18 with the top of the lower chamber 22. The row of passageways 34 extends in a direction generally parallel to the axial direction of each of the chambers 18,22 while each individual passageway 34 extends in a direction generally perpendicular to the axial direction of the chambers.

Waste or by-product particle fuel, for instance sawdust, is delivered by any suitable means, such as an auger 36, into the upper chamber 18 of the furnace 10 through a fuel inlet 38 in the top of the housing 14 and the cylindrical lining 16. The particle fuel falls through the inlet 38 toward the bottom of the upper chamber 18 and forms into a pile 40 which covers the chamber bottom and the passageways 34. The pile 40 grows in height within the upper chamber 18 until it reaches the general level seen in FIG. 1 at which a particle fuel delivery control device (not shown) is deactivated to terminate operation of the auger 36. As the pile 40 of particle fuel F burns and decreases in height, the particle fuel delivery control device, which is the invention described and illustrated in the patent application cross-referenced above, is again activated to cause operation of the auger 36 for rebuilding the pile 40. Thereafter, periodically, the pile is replenished by delivery of additional particle fuel through the top fuel inlet 38 of the housing 14.

Once ignited, the heat generated by a flame in the lower chamber 22 causes the pile 40 of particle fuel F to burn from the bottom adjacent to the location of the passageways 34. Combustible gases generated as by-products from the burning of the particle fuel in the upper chamber 18, along with air introduced into the upper portion of the upper chamber above the fuel pile 40, are drawn downward through the passageways 34 into the lower chamber 22 by a draft inducing fan 42 which communicates with the lower chamber 22 via a serially interconnected gasification tunnel 44 and swirl chamber 46. A particle fuel diversion structure 48 is incorporated into the furnace 10 at the bottom of the upper chamber 18 adjacent to and overlying the passageways 34 leading from the upper chamber 18 to the lower chamber 22. The diversion structure 48 creates a pair of slots 50 extending horizontally from the passageways 34 to the upper chamber 18 which relocate the position of the flame at the bottom of the pile 40 and prevent particles of fuel from falling through the passageways 34. The particle fuel diversion structure 48 comprises the invention described and illustrated in application Ser. No. 632,998, filed July 20, 1984 also by the inventor of the present invention.

Suitable heat transfer or recovery means, such as coil tubing or a pressure vessel (not shown), is located in either or both of the refractory linings 16,20 for capturing much of the heat produced by burning the particle fuel in the upper chamber 18 and combustible gases in the lower chamber 22. Also, most of the fly ash is removed from the remaining products of combustion in the lower chamber 22 by a cyclone ash collector 52 connected in communication with the lower chamber 22 via a branch tunnel 54 connected to the gasification tunnel 44. As the fly ash is collected in the collector 52, the exhaust gases pass to the atmosphere through a exhaust conduit 56.

Air Inlet Valve Subassembly with Replaceable Seal

The air drawn downward through the fuel pile 40 and into the lower chamber 22 through the passageways 34 with the combustible gases enters the upper chamber 18 through a pair of inlet tubes 58 which define openings 60 in the upper regions of opposite sides of the furnace 10. As mentioned earlier, optimum performance of the furnace 10 is only achieved if the air flow through the inlet tubes can be stopped completely when heat is not required. Stopping inflow of air prevents combustion in the furnace 10. If an air tight seal is not obtained, combustion continues at a low level which results in a smoldering fire that produces too much heat and causes deposition of creosote and water condensation within the furnace. Thus, the provision of some means for reliably providing an air tight seal, but which can be easily replaced when it fails so as to avoid extended shutdown of the furnace 10, is a requirement.

The air inlet valve subassembly 12, as seen in FIG. 1 mounted to each of the air inlet tubes 58 on the opposite sides of the furnace 10, substantially satisfies the aforementioned requirement. The preferred embodiment of the valve subassembly 12 is seen in greater detail in FIGS. 2 through 7.

Basically, the air inlet valve subassembly 12 includes air inlet means, generally designated 62, in the form of a manifold tube 64 and a hollow spout 66. The manifold tube 64 has inner and outer open ends 68,70 and defines an air passageway 72, with the tube being adapted to be mounted at its inner end 68 to one of the inlet tubes 58 of the furnace 10. The hollow spout 66 is attached to the outer end 70 of the manifold tube 64 and has a rim 74 which forms a valve opening 76. With such arrangement, the passageway 72 receives air from a suitable external source via the valve opening 76, and communicates the air into the upper chamber 18 via the respective one of its inlet tubes 58.

Further, the air inlet valve subassembly 12 includes a substantially rigid valve gate 78 having a flap 80 interconnected by a web 82 to an upper cross shaft 84 of the gate. The shaft 84 mounts the flap 80 for pivotal movement about a generally horizontal axis disposed adjacent and above the valve opening 76 formed by the rim 74 on the spout 66. With such arrangement, the valve flap 80 is mounted for movement toward and away from the spout rim 74 between a closed position, as seen in solid line form in FIG. 4, and an open position, as shown in dashed line form in FIG. 4, in which the valve opening 76 is respectively closed and opened to the communication of air from the external source, through the passageway 72 and inlet tube 58, and into the upper chamber 18.

More particularly, the valve subassembly 12 preferably includes a plate 86 mounted about the outer end 70 of the manifold tube 64 and a housing 88 mounted to the plate 86 so as to surround the valve flap 80 and the spout 66. In the preferred embodiment, the cross shaft 84 of the valve gate 78 is rotatably mounted to and extends between opposite sides 90,92 of the housing 88, while housing side 90 has a fitting 94 for connecting the housing 88 and thereby the manifold tube 64 in flow communication with the external source of air. Also mounted on the plate 86 spaced below the housing 88 is a thermostatically controlled solenoid actuator 96 which is interconnected by parallel linkage 98 to the valve flap 80 via the cross shaft 84. The actuator 96 is operable to rotate and counterrotate the shaft 84 so as to cause movement of the flap 80 between its closed and open positions. The housing 88 has a hinged door 100 which can be unlatched and opened to gain access to the inside of the housing.

Finally, the air inlet valve subassembly 12 includes a generally planar, resiliently flexible disk 102, preferably made of stainless steel to resist corrosion, which has opposite inner and outer sides 104,106, and an annular ring of gasket material 108 affixed by a suitable adhesive on the inner side 104 of the disk 102. The disk 102, generally circular in configuration, is removably mounted to the valve flap 80 such that its outer side 106 faces toward the flap and its opposite, inner side 104 faces toward the valve opening 76 formed by the spout rim 74. The size of the disk 102 is at least as large as the size of the spout rim 74 forming the valve opening 76 such that the portion of the disk 102 adjacent its periphery 110 which mounts the annular ring of gasket material 108 aligns with the rim 74 and disposes the annular ring of gasket material 108 therebetween. Thus, the annular ring of gasket material 108 is situated adjacent the periphery 110 of the disk 102 such that it is capable of contacting the rim 74 for providing an air seal about the valve opening 76 when the valve flap 80 is at its closed position and thereby a substantially air tight seal of the air inlet passageway 72 leading into the upper chamber 18.

Also, the planar disk 102 is mounted by a suitable fastening means, such as a single bolt 112, to the valve flap 80 at the respective centers thereof for facilitating easy removal of the disk 102 from the flap 80 should the gasket material 108 become damaged and need replacement. Still further, and just as important, such mounting relationship leaves the periphery 110 of the disk 102 free and unobstructed for insertion of means in the form of one or more wedge-shaped shims 114 between and in direct forcible contact with the valve flap 80 and the outer side 104 of the planar disk in order to deflect the disk periphery 110 away from the valve flap 80 and thereby modify and match the contour of the gasket material 108 on the inner side 104 of the disk 102 with the contour of the spout rim 74.

Figure 2:
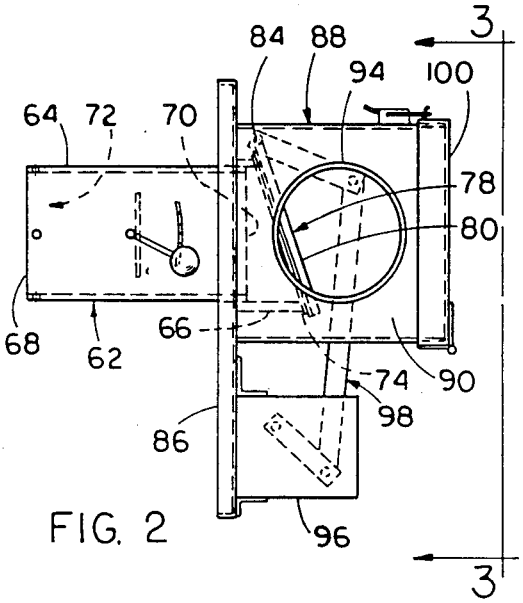
FIG. 2 is a side elevational view of the air intake valve subassembly of the present invention removed from the right side of the furnace of FIG. 1.
Figure 3:
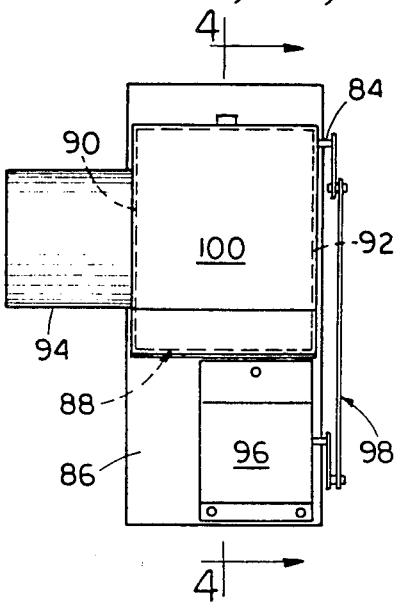
FIG. 3 is an end elevational view of the air intake valve subassembly as seen along line 3—3 of FIG. 2.
Figure 4:
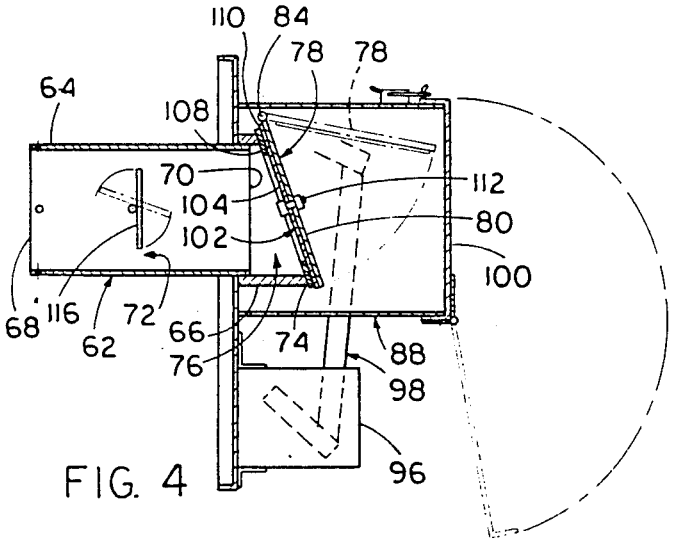
FIG. 4 is a sectional view of the air intake valve subassembly as taken along line 4—4 of FIG. 3.
Figure 7:
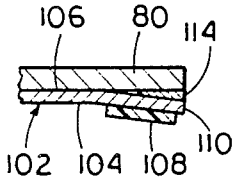
FIG. 7 is an enlarged fragmentary sectional view of the flap of the valve assembly as taken along line 7—7 of FIG. 6, showing a shim inserted between the flap and the periphery of the gasket disk on the opposite, outer side thereof.
Figure 6:
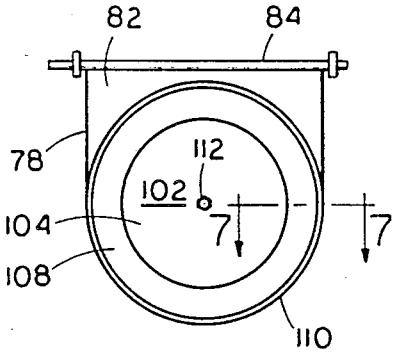
FIG. 6 is a rear elevational view of the valve flap of FIG. 5.
Figure 5:
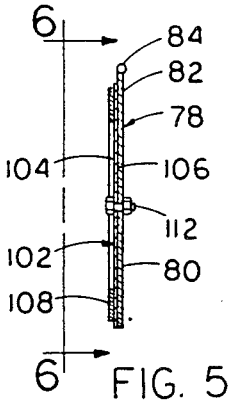
FIG. 5 is a sectional view of the flap of the valve subassembly with the disk mounted thereon having an annular gasket adhered about the periphery of its inner side.

As is also seen in FIGS. 1, 2 and 4, an air baffle 116 is pivotally mounted to the manifold tube 64 and extends across the air passageway 72 therethrough. It can be rotated to regulate the flow of air through the passageway to the rate desired. Also, it will be noted in FIG. 1 that the air valve subassembly 12 and each of the inlet tubes 62 onto which the manifold tube 64 of the subassembly is telescoped and attached by bolts 118 are inclined relative to the horizontal so as to direct any water condensation or creosote which might develop within the tubes 62,64 to run back into the upper chamber 18. Finally, it should be readily apparent that the valve subassembly 12 via its manifold tube 64 can be installed on either a new furnace during manufacture or retrofitted to a pre-existing furnace already in use.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. In a particle fuel burning furnace having a particle fuel holding and combustion chamber and means forming at least one opening in said chamber for entry of air into said chamber for support of combustion of particle fuel therein, an air inlet valve subassembly comprising:

(a) air inlet means connected to said chamber opening and having a rim forming a valve opening, said air inlet means defining a passageway for communicating air from an external source, through said valve opening, and into said chamber;

(b) a substantially rigid valve flap mounted adjacent said valve opening formed by said rim of said air inlet means for movement toward and away from said rim between closed and open positions in which said valve opening is closed and opened to the communication of air from said external source, through said passageway, and into said chamber;

(c) a generally planar, resiliently flexible disk having a periphery and opposite inner and outer sides and being removably mounted to said valve flap such that its outer side faces toward said flap and its opposite, inner side faces toward said valve opening formed by said rim;

(d) an annular ring of gasket material affixed on said inner side of a portion of said disk located adjacent said periphery thereof and being capable of contacting said rim of said air inlet means for providing an air seal about said valve opening when said valve flap is at its closed position and thereby a substantially air tight seal of said air inlet means passageway, said resiliently flexible disk having a size at least as large as that of said rim defining said valve opening such that said portion of the disk being located adjacent its periphery which mounts said annular ring of gasket material aligns with said rim and disposes said annular ring of gasket material therebetween; and (e) means insertable between said valve flap and said portion of said planar disk at said outer side thereof and adjacent said periphery thereof so as to deflect said disk portion and periphery away from said valve flap and thereby match the contour of said gasket material on said portion of said disk at said inner side thereof with the contour of said rim.

2. The valve subassembly as recited in claim 1, wherein said air inlet means includes:

a manifold tube having inner and outer open ends and defining said air communicating passageway, said tube being adapted to be mounted at its inner end to said furnace; and a hollow spout mounted to said outer end of said manifold tube and defining said rim.

3. The valve subassembly as recited in claim 2, wherein said valve flap is pivotally mounted adjacent to said spout.

4. The valve subassembly as recited in claim 2, further comprising:

an air baffle pivotally mounted to said manifold tube and extending across said passageway therethrough.

5. The valve subassembly as recited in claim 2, further comprising:

a plate mounted about said outer end of said manifold tube; and an actuator mounted to said plate and linked to said valve flap, said actuator being operable to cause movement of said flap between its closed and opened positions.

6. The valve subassembly as recited in claim 2, further comprising:

a plate mounted about said outer end of said manifold tube; and a housing mounted to said plate so as to surround said valve flap and spout, said housing having a fitting for connecting said housing in flow communication with said external source of air.

7. The valve subassembly as recited in claim 1, wherein said disk is made of stainless steel material.

8. The valve subassembly as recited in claim 1, wherein said insertable means is in the form of at least one shim.

9. The valve subassembly as recited in claim 1, further comprising:

fastening means for mounting said disk to said valve flap at the respective centers thereof.

10. An air inlet valve subassembly for use on a particle fuel burning furnace, said subassembly comprising:

(a) manifold tube having inner and outer open ends and defining a passageway for communicating air between said ends, said tube being adapted to be mounted at its inner end to said furnace;

(b) a hollow spout mounted to said outer end of said manifold tube and having an outer rim defining an opening to said passageway;

(c) a valve flap mounted adjacent to said spout for pivotal movement toward and away therefrom between closed and open positions in which said opening to said passageway of said manifold tube defined by said rim is closed and opened to the communication of air therethrough;

(d) a generally planar, resiliently flexible disk having a periphery and opposite inner and outer sides and being removably mounted to said valve flap such that its outer side faces toward said flap and its inner side faces toward said spout on said outer end of said manifold tube;

(e) an annular ring of gasket material affixed on said inner side of a portion of said disk located adjacent said periphery thereof, said annular ring being capable of contacting said rim of said spout for providing an air seal between said disk and said spout rim on said outer end of said manifold tube when said valve flap is at its closed position and thereby a substantially air tight seal of said manifold tube passageway, said resiliently flexible disk having a size at least as large as that of said rim defining said opening such that said portion of the disk being located adjacent its periphery which mounts said annular ring of gasket material aligns with said rim and disposes said annular ring of gasket material therebetween; and (f) at least one shim insertable between said valve flap and said portion of said planar disk at said outer side thereof and adjacent said periphery thereof so as to deflect said planar disk portion and periphery away from said valve flap and thereby match the contour of said gasket material on said portion of said disk at said inner side thereof with the contour of said spout rim.

11. The valve subassembly as recited in claim 10, further comprising:

an air baffle pivotally mounted to said manifold tube and extending across said passageway therethrough.

12. The valve subassembly as recited in claim 10, further comprising:

a plate mounted about said outer end of said manifold tube; and an actuator mounted to said plate and linked to said valve flap, said actuator being operable to cause movement of said flap between its closed and opened positions.

13. The valve subassembly as recited in claim 10, further comprising:

a plate mounted about said outer end of said manifold tube; and a housing mounted to said plate so as to surround said valve flap and spout, said housing having a fitting for connecting said housing in flow communication with an external source of air.

14. The valve subassembly as recited in claim 10, wherein said disk is made of resiliently flexible material for conforming to the contour of said spout rim.

15. The valve subassembly as recited in claim 14, wherein said disk is made of stainless steel material.

16. The valve subassembly as recited in claim 14, further comprising:

at least one shim insertable between said valve flap and said outer side of said planar disk to deflect said disk at the periphery thereof so as to match the contour of said gasket material on said inner side of said disk with the contour of said spout rim.

17. The valve subassembly as recited in claim 10, further comprising:

fastening means for mounting said disk to said valve flap at the respective centers thereof.

18. An air inlet valve subassembly for use on a particle fuel burning furnace, said subassembly comprising:

(a) a manifold tube having and outer open ends and defining a passageway for communicating air between said ends, said tube being adapted to be mounted at its inner end to said furnace;

(b) a hollow spout mounted to said outer end of said manifold tube and having an outer rim defining an opening to said passageway;

(c) a valve flap mounted adjacent to said spout for pivotal movement toward and away therefrom between closed and open positions in which said opening to said passageway of said manifold tube defined by said rim is closed and opened to the communication of air therethrough;

(d) a generally planar, resiliently flexible disk made of stainless steel material and having a periphery and opposite inner and outer sides, said disk being removably mounted to said valve flap at the respective centers thereof with its outer side facing toward said flap and its inner side facing toward said spout on said outer end of said manifold tube;

(e) an annular ring of gasket material affixed on said inner side of a portion of said disk located adjacent said periphery thereof, said annular ring being capable of contacting said rim of said spout for providing an air seal between said disk and said spout rim on said outer end of said manifold tube when said valve flap is at its closed position and thereby a substantially air tight seal of said manifold tube passageway, said resiliently flexible disk having a size at least as large as that of said rim defining said opening such that said portion of the disk being located adjacent its periphery which mounts said annular ring of gasket material aligns with said rim and disposes said annular ring of gasket material therebetween;

(f) at least one shim insertable between said valve flap and said portion of said planar disk at said outer side thereof and adjacent said periphery thereof to deflect said disk at the periphery thereof so as to match the contour of said gasket material on said inner side of said disk with the contour of said spout rim;

(g) a plate mounted about said outer end of said manifold tube adjacent said spout;

(h) an actuator mounted to said plate and linked to said valve flap, said actuator being operable to cause movement of said flap between its close and opened positions; and (i) a housing mounted to said plate so as to surround said valve flap and spout, said valve flap being pivotally mounted to said housing and said housing having a fitting for connecting said housing in flow communication with an external source of air.

* * * * *